US007820013B2

(12) United States Patent
Lindroos

(10) Patent No.: US 7,820,013 B2
(45) Date of Patent: Oct. 26, 2010

(54) SCREEN CYLINDER

(75) Inventor: Kati Lindroos, Lempäälä (FI)

(73) Assignee: Metso Paper, Inc., Helsinki (FI)

( * ) Notice: Subject to any disclaimer, the term of this patent is extended or adjusted under 35 U.S.C. 154(b) by 377 days.

(21) Appl. No.: 12/092,204

(22) PCT Filed: Oct. 31, 2006

(86) PCT No.: PCT/FI2006/050470

§ 371 (c)(1),
(2), (4) Date: Apr. 30, 2008

(87) PCT Pub. No.: WO2007/051908

PCT Pub. Date: May 10, 2007

(65) Prior Publication Data

US 2008/0277087 A1 Nov. 13, 2008

(30) Foreign Application Priority Data

Nov. 2, 2005 (FI) ..... 20055587

(51) Int. Cl.
*D21H 23/00* (2006.01)

(52) U.S. Cl. ..... 162/380; 209/397; 209/305; 210/498; 210/414

(58) Field of Classification Search ..... 162/380; 209/305, 307, 273, 397; 210/414, 498, 499
See application file for complete search history.

(56) References Cited

U.S. PATENT DOCUMENTS 5,587,077 A 12/1996 Aaltonen et al.
6,273,266 B1 8/2001 Schabel

FOREIGN PATENT DOCUMENTS

DE 91 08 129 U1 9/1991
DE 19609316 A1 9/1997

*Primary Examiner*—Mark Halpern
(74) *Attorney, Agent, or Firm*—Alston & Bird LLP

(57) ABSTRACT

A screen cylinder comprising screen slots (3) and accept channels (8) for directing the portion penetrated the screen slots (3) to an accept side (9) of the screen cylinder (1) of the fiber pulp suspension fed into a feed side (10) of the screen cylinder (1). At least one feed side surface (4) is provided between the screen slots (3) and the accept channels (8) comprise at least one first surface (5) of the accept channel (8) and at least one second surface (6). At least a third of the total length of the accept channel (8) is arranged in a direction opposite to a feed flow direction (A) of the fiber pulp suspension in relation to a normal (19) of a tangent (18) of the screen cylinder (1), which is arranged to pass through the screen slot (3).

12 Claims, 4 Drawing Sheets

SCREEN CYLINDER

This application is a 371 of PCT/F12006/050470 filed Oct. 31, 2006

BACKGROUND OF THE INVENTION

The invention relates to a screen cylinder for cleaning or screening fibre pulp suspension, the screen cylinder comprising screen slots and accept channels for directing the portion penetrated the screen slots to the accept side of the screen cylinder of the fibre pulp suspension fed into the feed side of the screen cylinder, and at least one feed side surface is provided between the screen slots and the accept channels comprise at least one first surface of the accept channel and at least one second surface of the accept channel.

The invention further relates to a screen wire of a screen cylinder comprising at least one feed side surface to be directed substantially in the direction of the feed side of the screen cylinder, at least one first surface to be directed in a substantially opposite direction in respect of a feed flow direction of a fibre pulp suspension and at least one second surface to be directed substantially in the same direction in respect of the feed flow direction of the fibre pulp suspension.

Screen cylinders are used for instance for cleaning and screening fibre pulp suspension. Screen cylinders can for example be manufactured by fastening parallel screen wires closely side by side in a cylindrical form such that a slot of a desired size remains between the screen wires. The screen wires form the screen or sorting surface of the screen cylinder. When employing the screen, the liquid in the fibre pulp suspension and the part of the fibres determined by the size of the slots are allowed to flow through the slots of the screen surface from the feed side or from the feed space of the screen cylinder to the accept side or to the accept space of the screen cylinder, and slivers, over-sized fibres, fibre bundles and the rest of the substance to be assorted remain on the feed side of the screen cylinder to be removed as reject from the screen. Depending on the embodiment the screen cylinder may be implemented in such a manner that the accept side of the screen cylinder is formed either on the inside or outside of the screen cylinder.

FIG. 1 schematically shows a prior art screen cylinder 1 and screen wire 2 seen from the end of the screen wire 2. FIG. 1 schematically shows three screen wires 2, which are arranged adjacent to each other at a distance from one another such that a screen slot 3 remains between them. For clarity, FIG. 1 does not show supporting wires or supporting bars, in connection with which the screen wires 2 are typically fastened. The screen wires 2 according to FIG. 1 comprise a feed side surface 4 to be directed substantially in the direction of a feed side 10 or a feed space 10 of the screen cylinder 1, a first surface 5 of an accept channel, a second surface 6 of the accept channel and an end surface 7 of the accept side connecting the first surface 5 and the second surface 6 of the accept channel. When placing screen wires 2 next to one another an accept channel 8 is thus formed between the first surface 5 and the second surface 6 of the accept channel, the accept channel extending from the screen slot 3 to an accept side 9 or an accept space 9. The feed side surfaces 4 of the screen wires 2 thus form together a screen surface 16 or a sorting surface 16 of the screen cylinder provided with screen slots 3 between the screen wires 2. In the position of the screen cylinder 1 shown in FIG. 1 the feed side 10 or the feed space 10 of the screen cylinder is found above the screen wires 2 and the accept side 9 or the accept space 9 of the screen cylinder 1 is found below the screen wires 2.

In the screen cylinder 1 according to FIG. 1 the feed side surface 4 of the screen wires 2 is formed to be oblique or slanting in relation to the tangent of the screen cylinder 1 such that when screen wires 2 are placed adjacent to one another a step is formed between the surfaces 4 of the feed side 10 in the feed direction of the fibre pulp suspension shown by arrow A in such a manner that a back part 4' of the feed side surface 4 of the previous screen wire 2 in the feed direction of the fibre pulp suspension is placed higher than the front part 4" of the feed side surface 4 of the latter screen wire 2 in the feed direction of the fibre pulp suspension. The aim of the profile of the feed side surface 4 of such a screen wire 2 is to provide a clockwise rotating turbulent whirl indicated by arrow B, as a consequence of which the bonds between the fibres are unravelled. After this the fibre pulp suspension flows into a screen slot 3, which forms a mechanical obstacle for the large particles in the fibre pulp suspension. After the screen slot 3 the cross-sectional area of the accept channel 8 increases and the flow rate of the fibre pulp suspension slows down before directing the flow into the accept space 9.

The whirl indicated by arrow B formed on the feed side 10 therefore reverts the flow direction of the fibre pulp suspension before the screen slot 3 to the opposite direction in relation to the flow direction of the fibre pulp suspension indicted by arrow A on the screen surface 16. As a consequence the fibre pulp suspension aims to continue the flow after having penetrated the screen slot 3 along the second surface 6 of the accept channel of the screen wire 2, i.e. as shown in FIG. 1 along the left-side edge of the accept channel 8 as shown by arrows C, whereby an area of slower flow rate is formed on the right side of the accept channel 8 as shown in FIG. 1, in which area a back flow whirl indicated by arrow D is easily created in the fibre pulp suspension that moves more slowly, which may cause the fibres to spin and the pressure loss of the screen to increase. What is further easily formed on the feed side surface of the screen wire 2 is a stagnation point 11 gathering impurities that cannot be cleaned with the rinsing flows of the screen wires 2 indicated by arrows E and directed backwards along the accept channel 8, since the rinsing flows are not directed in the same direction as the screen surface when being discharged from the screen slot 3 to the feed side 10.

Publication U.S. Pat. No. 6,273,266 shows a solution for keeping the screen surface clean by means of the rinsing flows of the screen. In the solution shown in the publication an extension is formed on the feed side of the screen wire that extends above the screen slot and further partly above the feed side surface of the following screen wire in the feed direction of the fibre pulp suspension. In accordance with the solution, the extension is implemented such that an angle, the size of which ranging from 3 to 45 degrees and preferably being 5 to 25 degrees, is formed between the lower surface of the extension and the feed side surface of the screen wire. Such an extension allows directing the rinsing flow arriving on the feed side from the accept channel during the rinsing flow along the feed side surface of the screen wire in the direction of rotation of feed side flow. In addition, the clockwise rotating whirl formed during the flow-through may be converted to a counter-clockwise rotating whirl. Together the rinsing flow along the feed side surface of the screen wire and the counter-clockwise rotating whirl rinse a layer formed during the flow-through period in the stagnation point on the feed side surface of the screen wire, thus keeping the screen cleaner than before. However, a problem with the screen according to publication U.S. Pat. No. 6,273,266 is still that a part of the fibre pulp suspension moving more slowly is formed on the accept channel, where the previously described back flow whirl can easily be formed, which may cause the fibres to spin and the pressure losses of the screen to increase.

BRIEF DESCRIPTION OF THE INVENTION

It is an object of the present invention to provide a new and improved screen cylinder.

The screen cylinder according to the invention is characterized in that at least a third of the total length of the accept channel is arranged in a direction opposite to a feed flow direction of the fibre pulp suspension to be fed in the screen cylinder in relation to a normal of a tangent of the screen cylinder, which is arranged to pass through the edge of the screen slot that is placed on the side of the first surface of the accept channel.

A screen wire of a screen cylinder according to the invention is characterized in that the angle between the first surface and the feed side surface is at least 90 degrees.

The screen cylinder comprises screen slots and accept channels for directing the portion penetrated the screen slots of the fibre pulp suspension fed in the feed side of the screen cylinder to the accept side of the screen cylinder, at least one feed side surface is placed between the screen slots and the accept channels comprise at least one first surface of the accept channel and at least one second surface of the accept channel. At least a third of the total length of the accept channel is arranged in the direction opposite to the feed flow direction of the fibre pulp suspension to be fed in the screen cylinder in relation to the normal of the tangent of the screen cylinder, which is arranged to pass through the edge of the screen slot that is placed on the side of the first surface of the accept channel. The total length or the length of the accept channel refers to the distance between the screen slot and the accept side of the screen cylinder measured along the first surface of the accept channel.

The screen cylinder provides such an advantage that the accept channel does not open sharply, whereby an area with a slower flow cannot be created on the accept channel that might cause the fibres to spin and the pressure loss on the accept side of the screen cylinder to increase.

According to an embodiment of the screen cylinder, the screen cylinder comprises several screen wires forming a screen surface of the screen cylinder, and screen slots between the screen wires, the screen wires comprising at least one feed side surface, at least one first surface of the accept channel and at least one second surface of the accept channel such that the feed side surfaces of the screen wires are arranged to form the screen surface of the screen cylinder and that the second surface of the accept channel of the previous screen wire in the feed flow direction of the fibre pulp suspension and the first surface of the accept channel of the following screen wire in the feed flow direction of the fibre pulp suspension are arranged to form the accept channel between them. When forming the screen cylinder by means of the screen wires, the screen cylinder may be fairly easily implemented.

BRIEF DESCRIPTION OF THE DRAWINGS

In the following embodiments of the invention are explained in greater detail in the accompanying drawings, in which FIG. 1 schematically shows a prior art screen cylinder 1 and a screen wire seen from the end of the screen wire.

For clarity, some of the embodiments of the invention are shown in simplified form. Similar parts are indicated with the same reference numerals in the Figures.

DETAILED DESCRIPTION OF THE EMBODIMENTS OF THE INVENTION

Figure 1:
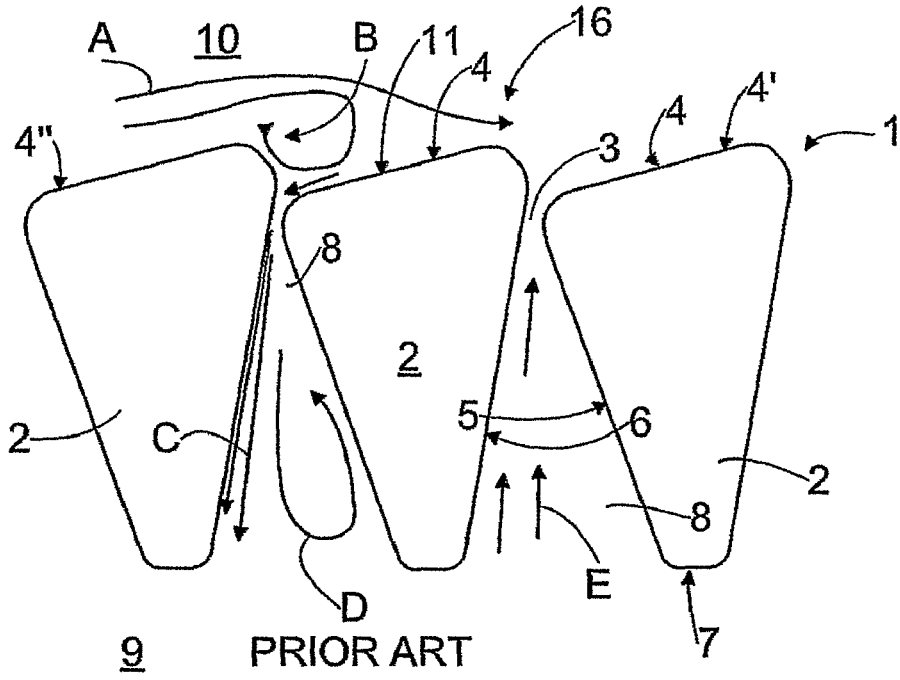
Figure 2:
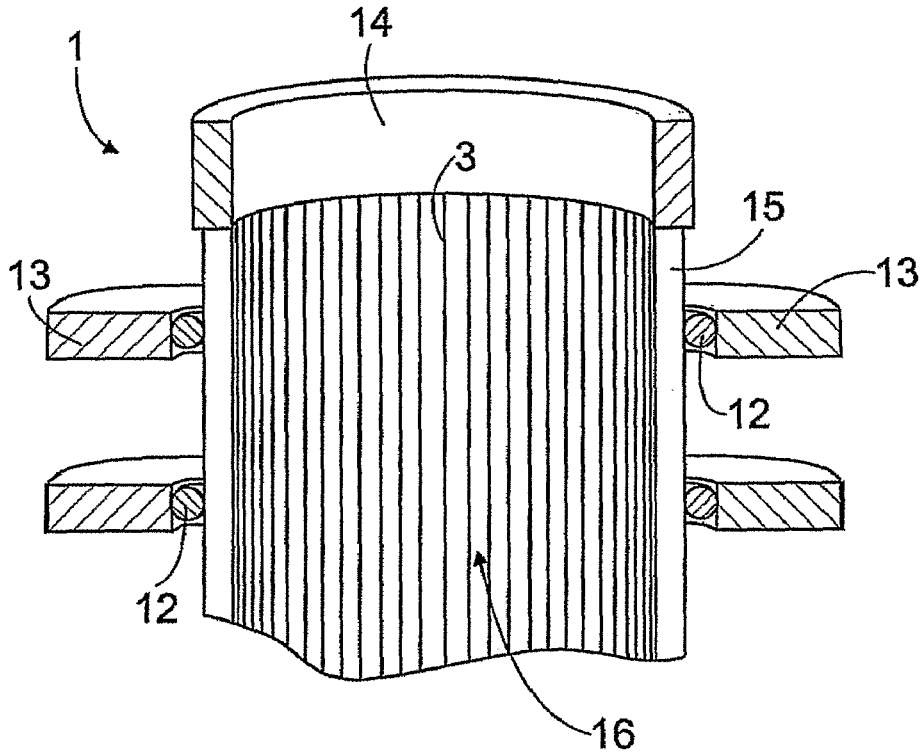
FIG. 2 schematically shows a general view of the basic structure of a screen cylinder in cross-section in the direction of the screen cylinder axis.

FIG. 2 schematically shows a basic structure of a screen cylinder 1 in cross-section in the direction of the axis of the screen cylinder 1. The screen cylinder 1 comprises screen wires 15 surrounding the whole circumference of the screen cylinder so as to form a screen surface 16 or a sorting surface 16. Screen slots 3 are provided between the screen wires 15, through which screen slots the liquid in the fibre pulp suspension fed in the feed side 9 of the screen cylinder 1, or in this case inside the screen cylinder 1, and a desired part of the fibres are allowed to flow from the feed side 9 of the screen cylinder 1 to the accept side 10, or in this case outside the screen cylinder 1, at the same time as slivers and fibres that are excessive in size, fibre bundles and a substance to be separated remain inside the screen cylinder 1 to be removed as reject. The screen wires 15 are typically fastened to supporting bars 12 or supporting wires 12. The supporting bars 12 are placed at appropriate intervals in the direction of the axis of the screen cylinder 1 such that the screen wires 15 remain sufficiently rigidly and firmly in position. Supporting rings 13 may also be mounted around the supporting bars 12, the supporting rings support the supporting bars 12 and receive in the screen cylinder 1 the forces achieved by the pressure difference caused by different varying pressures on different sides of the screen cylinder and thus reinforce the structure of the screen cylinder 1. FIG. 2 further shows an end ring 14 to be mounted at the ends of the screen cylinder 1, said ring allowing the screen cylinder 1 to be supported on the frame of the screen.

FIGS. 2 to 6 and 8 show the screen surface 16 of the screen cylinder 1, which is formed by means of the screen wires 15. The screen surface 16 of the screen cylinder 1 can also be formed of an originally closed cylindrical structure by providing the structure with screen slots 3 and accept channels 8, for instance using mechanical machining or spark machining. The structure, manufacture and operating principle of different screens and screen cylinders are known per se to those skilled in the art, and are therefore not explained in more detail in this context.

Figure 3:
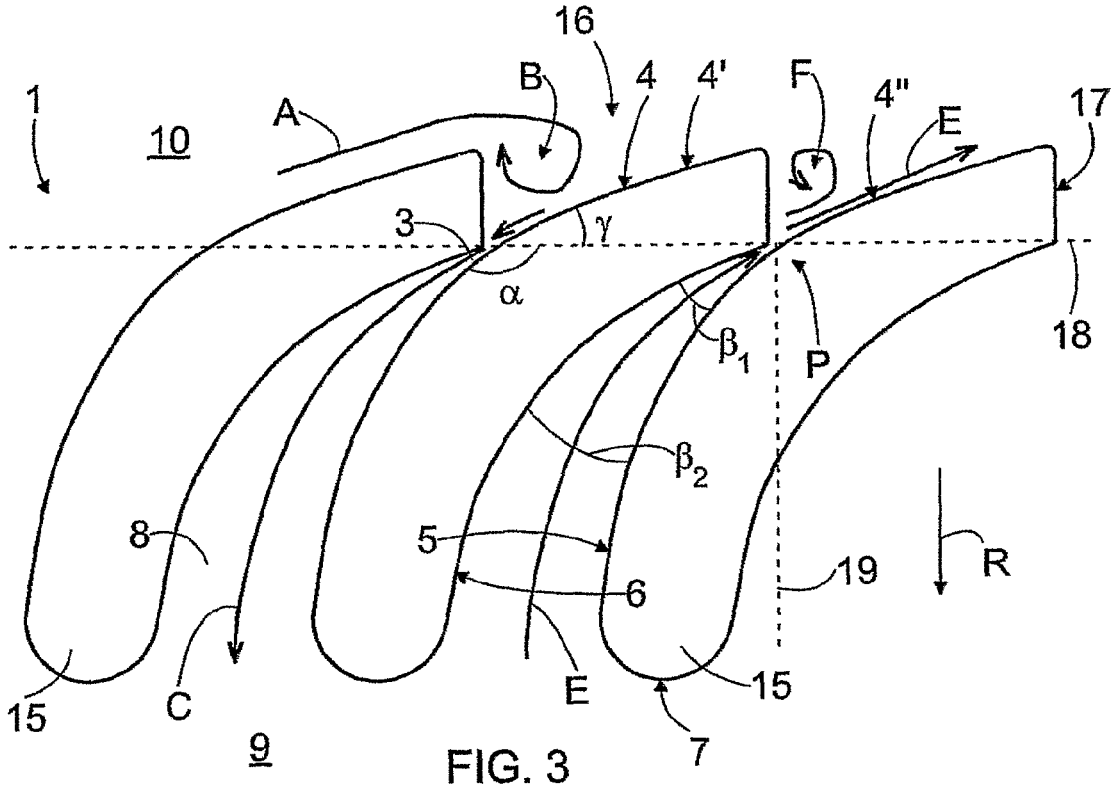
FIG. 3 schematically shows a second screen cylinder and a screen wire seen from the end of the screen wire.

FIG. 3 schematically shows a second screen cylinder 1 and a screen wire 15 seen from the end of the screen wire 15. For clarity, FIG. 3 does not show the supporting bars 12 and the supporting rings 13 of the screen cylinder 1. FIG. 3 shows three screen wires 15 placed next to one another, which are located at least partly along the longitudinal course of the screen wires 15 in relation to one another in such a manner that a screen slot 3 is provided between them. Each screen wire 15 comprises a feed side surface 4, a first surface 5 of the accept channel and a second surface 6 of the accept channel. The screen slot 3 divides the surface on the left side of the screen wire 15 shown in FIG. 3 into two parts such that the part on the feed side 10 of the screen cylinder 1 in relation to the screen slot 3 of the surface of said screen wire 15 is the feed side surface 4 of the screen wire 15 and the part on the accept side of the screen cylinder 1 of the surface of said screen wire 15 is the first surface 5 of the accept channel. Thus, the screen slot 3 is a structure that restricts the size of the fibres passing from the feed side 10 to the accept side 9 of the screen cylinder. What forms the screen slot 3 in practice is precisely the spot, where while the fibre pulp suspension flows from the feed side 10 of the screen cylinder 1 to the accept side 9, the distance between two adjacent screen wires 15 from one another or the distance between other screen slots 3 or the surfaces of a corresponding structure from one another is at the smallest, meaning that where the distance between two adjacent screen wires 15 from one another substantially in the transverse direction in relation to the flow direction of the fibre pulp suspension or the distance between the surfaces forming the screen slot 3 or a corresponding structure from one another substantially in the transverse direction in relation to the flow direction of the fibre pulp suspension is at the smallest. The screen wires 15 are arranged in relation to one another next to each other such that the second surface 6 of the accept channel of the first screen wire 15 in feed direction A of the fibre pulp suspension and the first surface 5 of the accept channel of the latter screen wire 15 in feed direction A of the fibre pulp suspension thus restrict the accept channel 8, through which the portion of the fibre pulp suspension penetrated the screen slot 3 is transferred from the feed side 10 of the screen cylinder to the accept side 9. The fibre pulp suspension is substantially fed in the direction of the circumference of the screen cylinder 1, meaning that feed direction A of the fibre pulp suspension is therefore substantially in the direction of the circumference of the screen cylinder, as shown in the Figures. Depending on the embodiment the screen cylinder 1 may be implemented naturally also in such a manner that the accept side 9 of the screen cylinder 1 is placed within the screen cylinder 1.

Each of the screen wires 15 according to FIG. 3 further comprises an end surface 7 of the accept side joining the first surface 5 of the accept channel and the second surface 6 of the accept channel. In the case shown in FIG. 3 the end surface is substantially shaped as an arc in a circle. In addition the screen wires 15 according to FIG. 3 comprise an end surface 17 of the feed side joining the feed side surface 4 and the second surface 6 of the accept channel. In the case shown in FIG. 3 the end surface is substantially an even surface. Also, in the screen cylinder 1 according to FIG. 3, the screen wires 15 are arranged in relation to one another such that a step is formed in the feed direction of the fibre pulp suspension shown by arrow A between the feed side surfaces 4 of the adjacent screen wires 15 such that the back part 4' of the feed side surface 4 of the previous screen wire 15 in feed direction A of the fibre pulp suspension is higher than the front part 4" of the feed side surface 4 of the latter screen wire 15 in feed direction A of the fibre pulp suspension. The feed side surface 4 of the screen wires 15 therefore rises obliquely in feed flow direction A of the fibre pulp suspension. The feed side surfaces 4 of the screen wires 15 form the screen surface 16 of the screen cylinder 1.

The screen surface 16 of the screen cylinder 1 according to FIG. 3 is provided with gradations so that the back part 4' of the feed side surface 4 of the previous screen wire 15 in feed direction A of the fibre pulp suspension is higher than the front part 4" of the feed side surface 4 of the latter screen wire 15 in the feed direction of the fibre pulp suspension. Thus the object is to create on the screen surface 16 a clockwise rotating turbulent whirl as shown by arrow B and as a result thereof the bonds between the fibres are unravelled. After this the fibre pulp suspension flows to the screen slot 3, which forms a mechanic obstacle to the large particles.

The screen wires 15 of the screen cylinder 1 according to FIG. 3 are implemented so that the feed side surface 4, the first surface 5 of the accept channel and the second surface 6 of the accept channel all form continuously curved surfaces. The feed side surface 4 of the screen wire 15 is implemented such that an elevation angle $\gamma$ of the feed side surface 4 of the screen wire 15 is provided at the screen slot 3 between the tangent of the screen cylinder 1, which is schematically indicated with a dashed line 18 in FIG. 3, and the feed side surface 4 of the screen wire 15. The elevation angle may range for instance from 0 to 45 degrees, preferably from 5 to 20 degrees. The elevation angle may be constant or changing and it may also be zero in a part of the feed side surface 4, but the average elevation angle must exceed zero in order to form a step in connection with the screen slot 3 in the flow direction of the fibre pulp suspension, the step creating a whirl indicated by arrow B that is necessary for the operation of the screen. The first surface 5 of the accept channel of the screen wire 15 is implemented such that a direction angle $\alpha$ of the first surface of the accept channel of the screen wire 15 is provided between the tangent 18 of the screen cylinder 1 and the first surface 5 of the accept channel of the screen wire 15. The size of the direction angle $\alpha$ may vary at least on the first portion of the accept channel 8 after the screen slot 3 for instance between 90 and 170 degrees, preferably between 110 and 160 degrees and most preferably between 130 and 150 degrees depending on the elevation angle $\gamma$ of the feed side surface 4 of the screen wire 15. The greater the direction angle is, the less the flow direction of the fibre pulp suspension close to the screen slot 3 changes in the direction of back flow whirl B and the smaller the pressure loss becomes and the less wear occurs on the surfaces of the feed side 10 of the screen cylinder 1 and on the surfaces of the accept channel 8. It is therefore preferable to select a large enough direction angle $\alpha$. However, what restricts directing the accept channel 8 in the opposite direction in relation to feed flow direction A is the prolongation of the accept channel 8 and the increase in energy consumption caused thereby and also the possibly more complicated cleaning of the accept channel 8.

The second surface 6 of the accept channel is in turn formed such that an opening angle $\beta$ is provided on the accept channel 8 formed of the first surface 5 of the accept channel and the second surface 6 of the accept channel of the adjacent screen wires 15, the opening angle increasing or decreasing when transferring towards the accept side 9 of the screen cylinder 1. The opening angle $\beta$ may range between 5 to 45 degrees, preferably between 10 to 30 degrees. The opening angle $\beta$ of the accept channel 8 in the screen wire 15 according to FIG. 3 changes in such a manner that the opening angle $\beta$ decreases when transferring towards the accept side 9 of the screen cylinder 1, meaning that $\beta_1$ shown in FIG. 3 is greater than $\beta_2$. Furthermore, the first surface 5 and the second surface 6 of the accept channel of the screen wire 15 in the screen cylinder 1 according to FIG. 3 are formed such that the accept channel 8 remaining between the two adjacent wires 15 is arranged to turn in the direction of the radius of the screen cylinder 1 before the accept channel 8 opens to the accept side 9 of the screen cylinder 1.

The screen cylinder 1 according to FIG. 3 and the screen wires 15 thereof implement in practice the solution, in which the accept channel 8 between the screen wires 15 is arranged in its entirety in the direction opposite the feed flow direction A of the fibre pulp suspension to be fed in the screen cylinder 1 in relation to the normal 19 or the imaginary normal 19 of the tangent 18 of the screen cylinder that is arranged to pass through the edge of the screen slot 3 that is on the side of the first surface 5 of the accept channel 8. The normal 19 of the tangent 18 of the screen cylinder is therefore arranged to pass through the edge of the screen slot 3 that is the rear edge of the screen slot 3 in feed flow direction A of the fibre pulp suspension. This position is indicated by arrow P in FIG. 3. In FIG. 3 the normal 19 of the tangent 18 of the screen cylinder 1 is indicated with a dashed line 19. In practice the solution means that the accept channel 8 is not opened sharply but increases gradually without flow technically impeding sharp direction changes or gradations, whereby a slower flow area is not created on the accept channel that would cause a back flow whirl on the accept channel 8, which could further cause the fibres to spin and the pressure loss to increase on the accept side 9 of the screen cylinder 1. In addition, the flow indicated by arrow B that has turned backwards in respect of feed direction A of the fibre pulp suspension on the feed side 10 of the screen cylinder 1 may be directed to the screen slot 3 between the screen wires 15 in the flow direction formed in such a manner, at first almost not changing direction, in which case the flow rate of the fibre pulp suspension is not reduced and the creation of pressure loss is almost insignificant on the feed side 10 of the screen cylinder 1.

The solution also provides such an advantage that the flow direction of the fibre pulp suspension shown by arrow C on the accept channel 8 is not abruptly turned after the screen slot 3 from tangential to radial, which also causes unnecessary pressure loss. A further advantage is that the rinsing flow or return flow described by arrow E can be implemented in such a manner that the return flow efficiently rinses the feed side surface 4 of the screen wire and that the losses caused by the impact of the return flow taking place at the screen slot 3 remain small. During the return flow a counter-clockwise rotating whirl indicated with reference numeral F may be created close to the feed side surface, the whirl intensifying the cleaning of the screen surface 16. When the accept channel 8 turns in the direction of the radius of the screen cylinder 1, the tangential flows of the accept space 9 of the screen cylinder 1 do not affect the operation of the screen cylinder 1 or the screen wire 15 on different sides of the screen.

Instead of increasing the opening angle β of the accept channel 8 when transferring towards the accept side 9 of the screen cylinder 1, the opening angle β of the accept channel 8 may also decrease or remain unchanged while transferring towards the accept side 9 of the screen cylinder 1. When the opening angle of the accept channel 8 is at first sufficiently wide, a sufficient amount of flow space is formed on the accept channel 8 that improves the throughput of the accept channel 8. However, the opening angle may not be so wide that the flow disengages from the walls of the accept channel 8. From the start a sufficient amount of flow space is formed on the accept channel of the present type and the flow cross-sectional area of the accept channel 8 increases preferably along the entire length of the accept channel 8 in such a manner that the flow remains detached to the walls of the accept channel 8. Consequently the pressure loss caused by the accept channel 8 remains small and the curling of the accept material is avoided and the flow is maintained laminar. On account of these facts the throughput of the accept channel 8 remains high. A decrease in the flow cross-sectional area of the accept channel 8 is not preferable, since the flow rate could then increase and possibly decrease again when removing the accept channel. Such an additional increase and decrease in the flow rate might use energy unnecessarily. A decrease in the flow cross-sectional area of the accept channel 8 towards the accept side 9 would in turn also cause a decline in the efficiency concerning the rinsing flow of the accept channel 8, whereby the accept channel 8 could remain partly uncleaned and could even be blocked. It is therefore not preferable for the opening angle of the accept channel 8 to be reduced so much that the flow cross-sectional area of the accept channel 8 is decreased.

Figure 4:
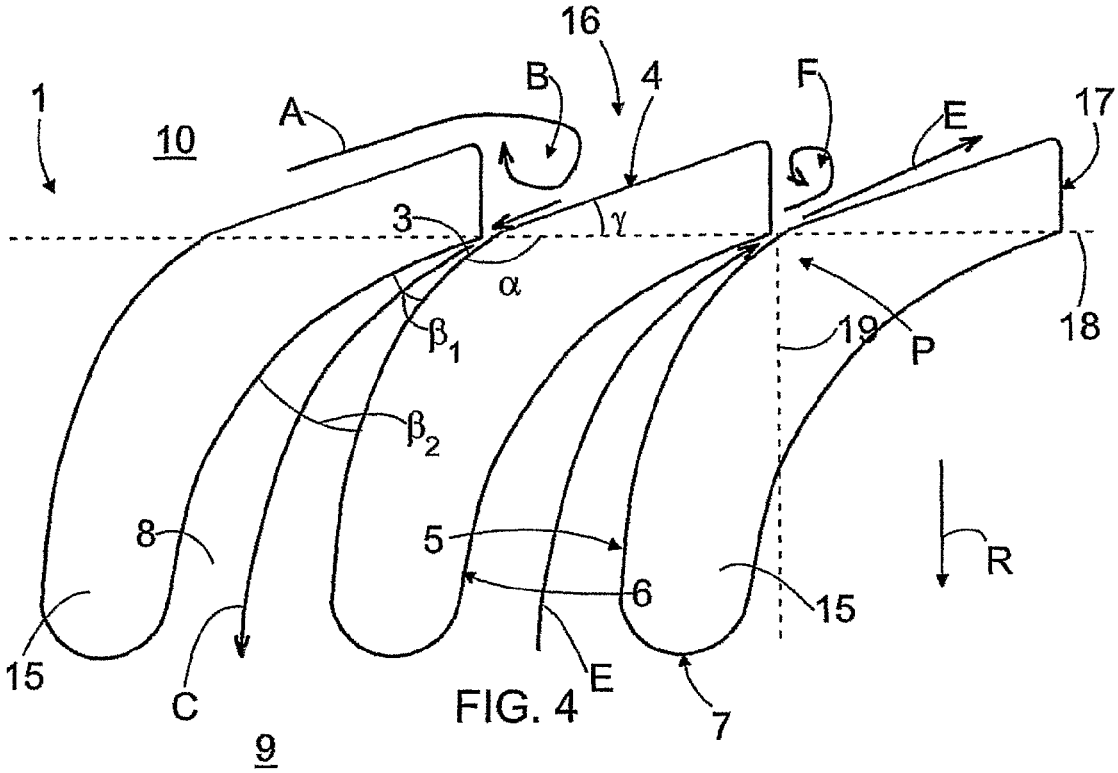
FIG. 4 schematically shows a third screen cylinder and a screen wire seen from the end of the screen wire.

FIG. 4 schematically shows a third screen cylinder 1 and a screen wire 15 seen from the end of the screen wire 15. For clarity, FIG. 4 does not show the supporting bars 12 and supporting rings 13 of the screen cylinder 1. The screen cylinder according to FIG. 4 and the screen wires 15 thereof correspond substantially completely with the solution shown in FIG. 3, except that the feed side surface 4 of the screen wire 15 according to FIG. 4 is provided with a substantially straight surface.

Figure 5:
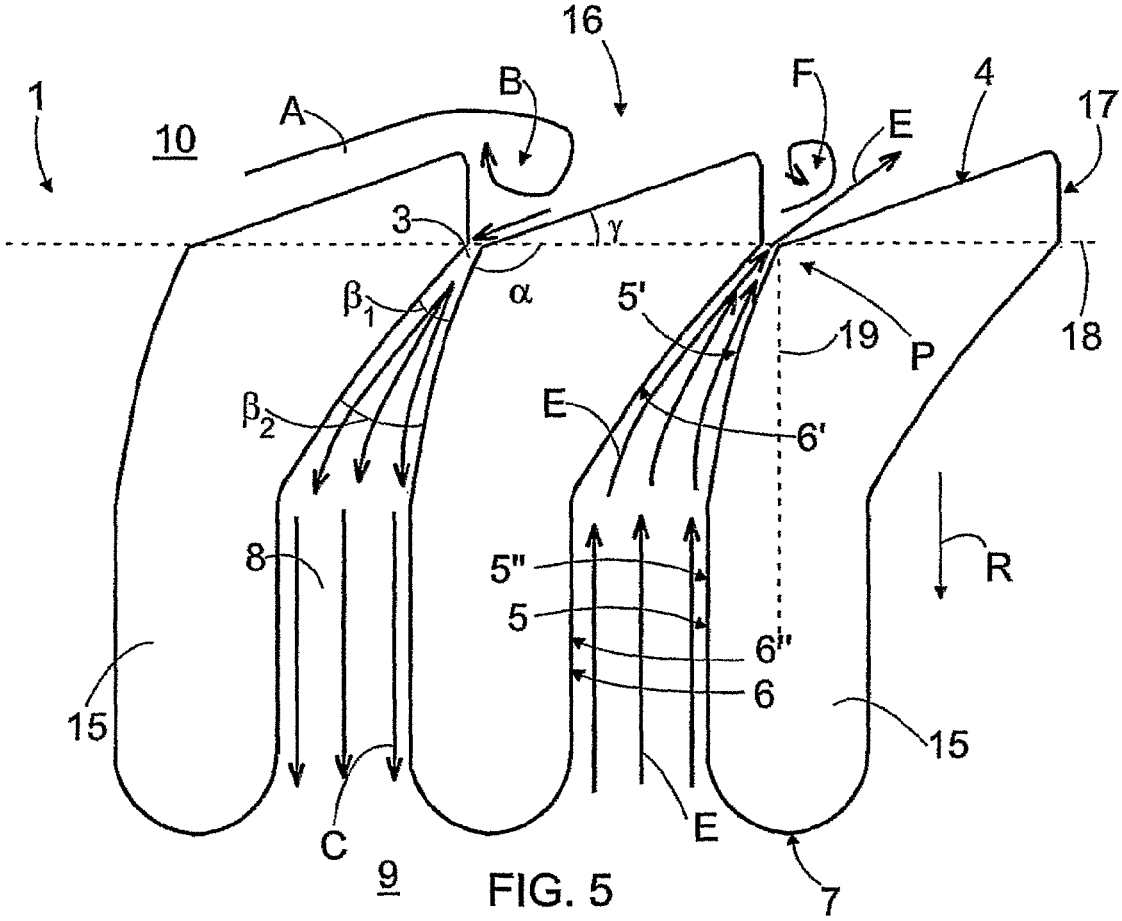
FIG. 5 schematically shows a fourth screen cylinder and a screen wire seen from the end of the screen wire.

FIG. 5 schematically shows a fourth screen cylinder 1 and a screen wire 15 seen from the end of the screen wire 15. For clarity, FIG. 5 does not show the supporting bars 12 and the supporting rings 13 of the screen cylinder 1. The screen cylinder 1 according to FIG. 5 and the screen wire 15 correspond substantially completely with the solution shown in FIG. 4, except that in the solution shown in FIG. 5 the first surface 5 of the accept channel of the screen wire 15 is formed of two surface parts 5' and 5", whereof the first surface part 5' in the direction of propagation of the accept channel 8 or provided after the screen slot 3 in the direction of radius R of the screen cylinder 1 is continuously curved and the second surface part 5" is substantially straight and in the case shown in FIG. 5 also in the direction of radius R of the screen cylinder 1, even though it could naturally also be at an angle in relation to radius R of the screen cylinder 1. The surface parts 5' and 5" are joined together advantageously as regards the flow without a sharp change of direction or gradation.

In addition, the second surface 6 of the accept channel of the screen wire 15 according to FIG. 5 is formed of two surface parts 6' and 6" joined together preferably as regards the flow without a sharp change of direction or gradation. In the direction of propagation of the accept channel 8 the first surface part 6' provided after the screen slot 3 in the direction of radius R of the screen cylinder 1 is continuously curved and the latter surface part 6" is substantially straight and in the case shown in FIG. 5 also in the direction of radius R of the screen cylinder 1, even though it could naturally also be at an angle in relation to radius R of the screen cylinder 1. In the solution according to FIG. 5 the opening angle $\beta_1$ of the accept channel 8 provided immediately after the screen slot 3 is 19 degrees. At the end of the curved portion of the accept channel 8 the opening angle $\beta_2$ of the accept channel 8 is 22 degrees and on the straight portion of the accept channel 8 the opening angle β of the accept channel 8 is naturally 0 degrees. The screen cylinder 1 according to FIG. 5 is also provided with a changing opening angle β of the accept channel 8, but in such a manner that the opening angle β in the direction of propagation of the accept channel 8 first increases and then decreases.

In all the solutions according to FIGS. 3 to 5 the accept channel 8 is provided with at least one portion, in which the opening angle β of the accept channel 8 continuously changes, i.e. at least either the first surface 5 or the second surface 6 of the accept channel of the screen wire 15 comprises a continuously curved surface part.

Figure 8:
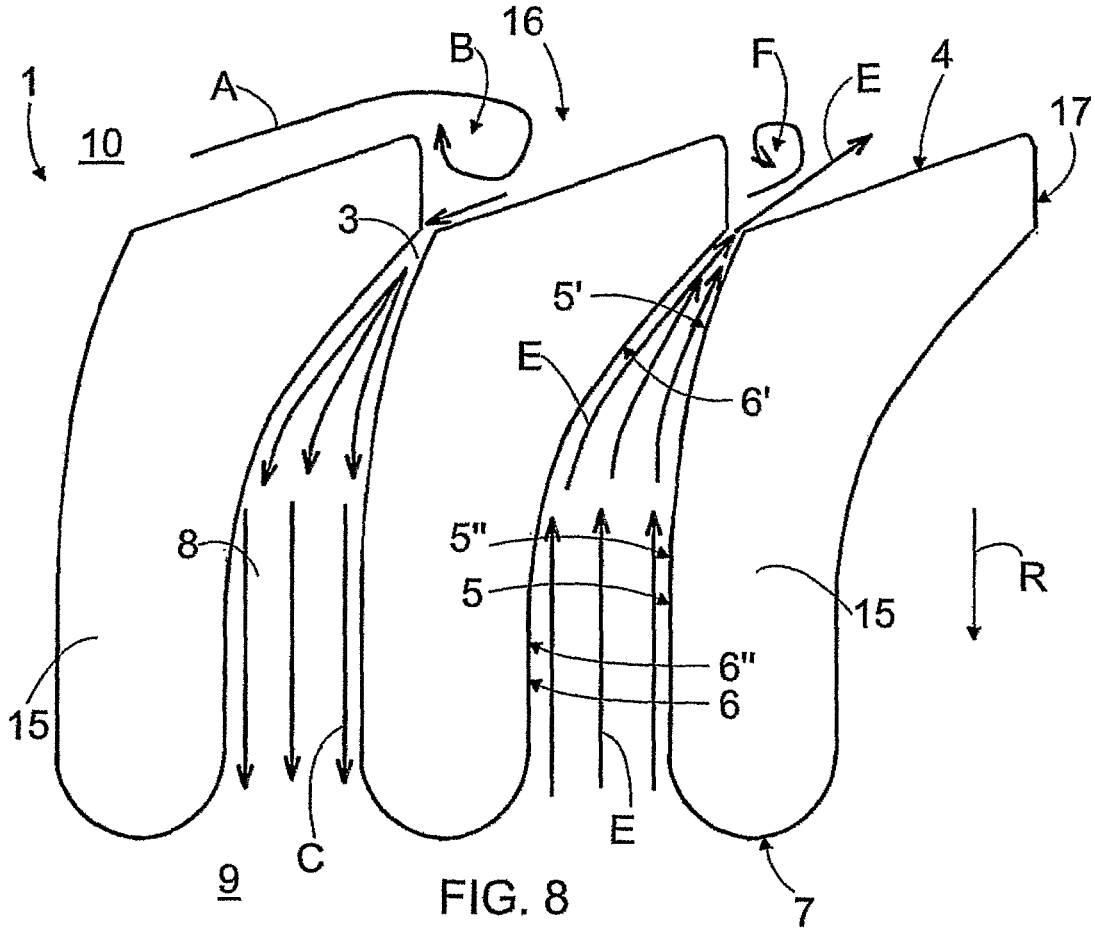
FIG. 8 schematically shows a seventh screen cylinder and a screen wire seen from the end of the screen wire.

FIG. 8 further shows a screen cylinder 1 of the type shown in FIG. 5, but in which the first surface part 5' and the second surface part 5" of the first surface of the accept channel 8 as well as the first surface part 6' and the second surface part 6"

of the second surface of the accept channel 8 are joined together without an angle between them.

Figure 6:
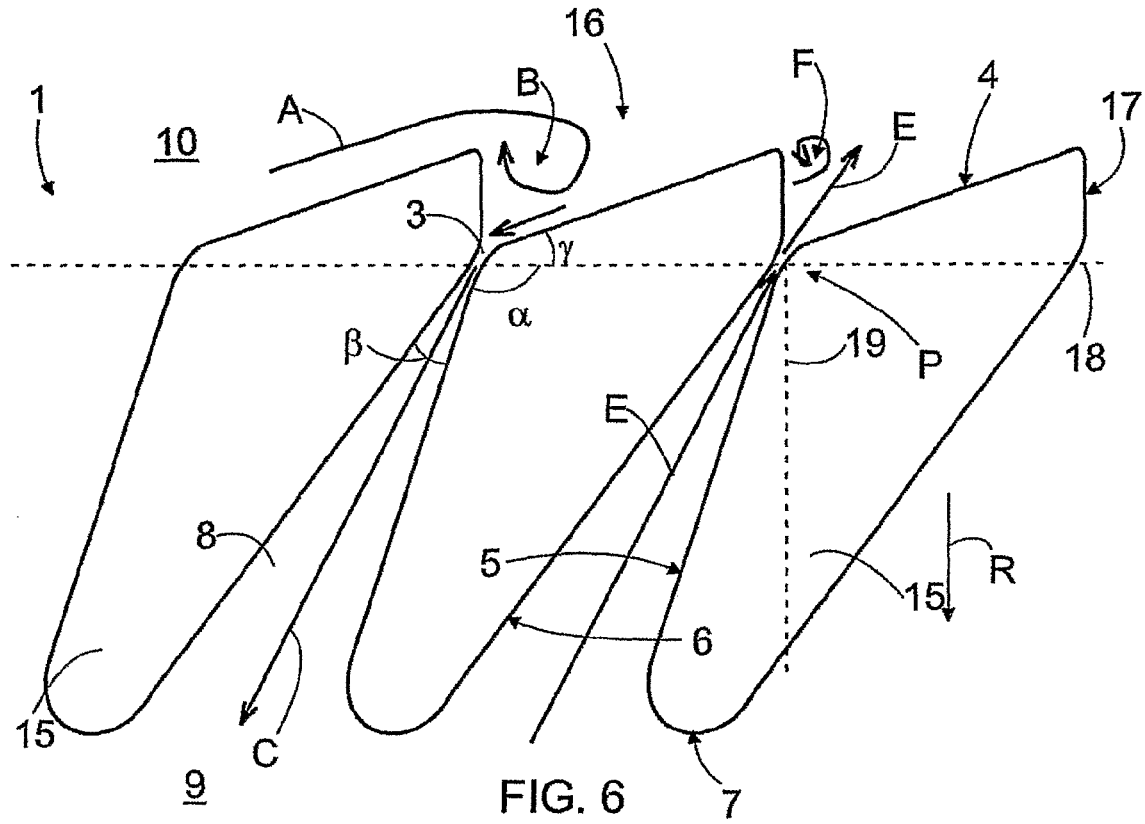
FIG. 6 schematically shows a fifth screen cylinder and a screen wire seen from the end of the screen wire.

FIG. 6 schematically shows a fifth screen cylinder 1 and a screen wire 15 seen from the end of the screen wire 15. For clarity, the supporting bars 12 and the supporting rings 13 of the screen cylinder 1 are not shown in FIG. 6. In the solution according to FIG. 6 the first surface 5 and the second surface 6 of the accept channel of the screen wire 15 are substantially straight surfaces and the accept channel 8 opens towards the accept side 9 of the screen cylinder 1 at a standard angle β. Consequently the accept channel 8 does not turn in the direction of radius R of the screen cylinder 1.

A feature common to all the solutions shown in FIGS. 3 to 6 and 8 is that at the screen slot 3 a direction angle α of at least 90 degrees of the first surface 5 of the accept channel of the screen wire 15 is provided between the tangent 18 of the screen cylinder 1 and the first surface 5 of the accept channel. What is therefore common to all the solutions shown in FIGS. 3 to 6 is that the accept channel 8 between the screen wires 15 is arranged in its entirety in the direction opposite to feed flow direction A of the fibre pulp suspension to be fed in the screen cylinder 1 in relation to the normal or the imaginary normal 19 of the tangent 18 of the screen cylinder 1 that is arranged to pass through the edge of the screen slot 3, which is on the side of the first surface of the accept channel 8.

Furthermore in all the solutions according to FIGS. 3 to 6 and 8 the end surface 17 of the feed side of the screen wire 15 is in the direction of radius R of the screen cylinder 1, in which case it forms a 90 degree angle in relation to the direction of the tangent 18 of the screen cylinder. The angle in question in relation to the tangent of the screen cylinder 1 may also range for instance between 45 and 135 degrees, preferably between 70 and 100 degrees.

Figure 7:
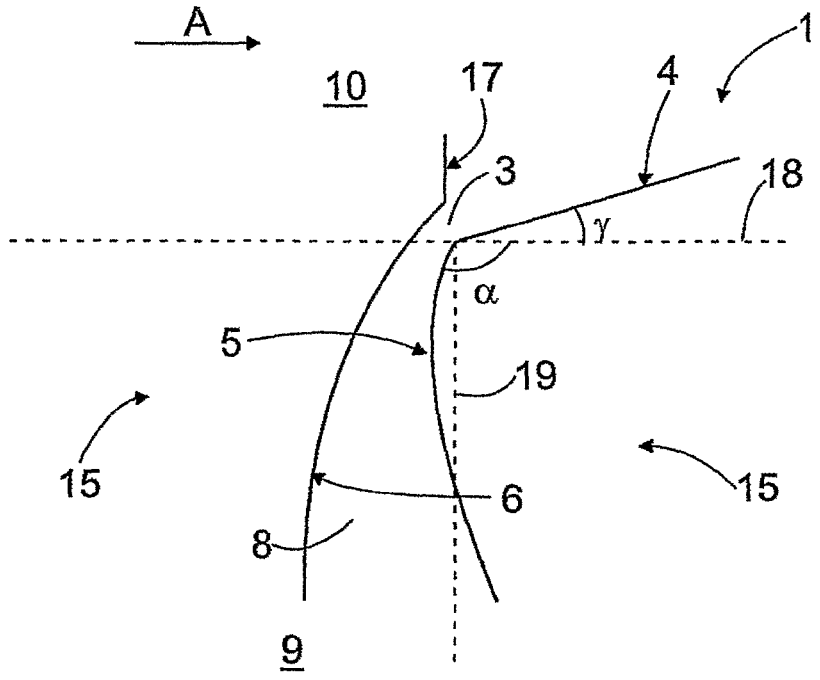
FIG. 7 schematically shows a sixth screen cylinder.

FIG. 7 schematically shows a sixth screen cylinder 1, in which the entire length of the accept channel 8 is not located along in the direction opposite to feed flow direction A of the fibre pulp suspension to be fed in the screen cylinder 1 in relation to the normal 19 of the tangent 18 of the screen cylinder 1. In the embodiment shown in FIG. 7 more than half of the total length of the accept channel 8 is located in the direction opposite to feed flow direction A of the fibre pulp suspension to be fed in the screen cylinder 1 in relation to the normal 19 of the tangent 18 of the screen cylinder 1. However, according to the solution at least a third of the total length of the accept channel 8 is located in the direction opposite to feed flow direction A of the fibre pulp suspension to be fed in the screen cylinder 1 in relation to the normal of the tangent 18 of the screen cylinder 1, i.e. at least a third of the total length of the accept channel 8 is located in its entirety, i.e. the whole flow cross-section thereof, in the direction opposite to feed flow direction A of the fibre pulp suspension to be fed into the screen cylinder 1 in relation to the normal of the tangent 18 of the screen cylinder 1. In some cases, depending on the properties of the pulp to be processed, at least half of the total length of the accept channel 8 is located in the direction opposite to feed flow direction A of the fibre pulp suspension to be fed in the screen cylinder 1 in relation to the normal of the tangent 18 of the screen cylinder 1 in order to ensure the appropriate screening or sorting operations of the screen cylinder 1. In the screen cylinder according to FIG. 7, the direction angle α of the first surface of the accept channel between the tangent 18 of the screen cylinder 1 and the first surface 5 of the accept channel is, however, at least 90 degrees after the screen slot 3 in the first part of the accept channel 8. In practice the direction angle α may vary in the first part of the accept channel 8 after the screen slot 3, for instance between 90 and 170 degrees, preferably between 110 and 160 degrees and most preferably between 130 and 150 degrees depending on the elevation angle γ of the feed side surface 4 of the screen wire 15. In the back part of the accept channel 8 the direction angle α of the first surface 5 of the accept channel may be smaller than 90 degrees as shown in FIG. 7, meaning that the accept channel 8 is arranged in the back part thereof to turn in the direction corresponding to feed flow direction A of the fibre pulp suspension.

Also in the solution according to FIG. 7 the accept channel 8 is arranged to increase when transferring from the screen slot 3 towards the accept side 9 of the screen cylinder 1. The opening angle β of the accept channel 8 may be for instance 5 to 45 degrees, preferably 10 to 30 degrees.

Also in the solution according to FIG. 7 the flow that has turned backwards in relation to feed direction A of the fibre pulp suspension on the feed side 10 of the screen cylinder 1 may be directed to the screen slot 3 between the screen wires 15 in a flow direction formed in such a way at first almost not changing the direction thereof, in which case the flow rate of the fibre pulp suspension does not decrease and no pressure loss is formed on the feed side 10 of the screen cylinder 1. Furthermore owing to the accept channel 8 opening without sharp changes of direction or gradations that are flow technically impeding, an area of slower flow may not be formed on the accept channel 8 that would cause a back flow whirl on the accept channel 8 that could also cause the fibres to spin and the pressure losses to increase on the accept side 9 of the screen cylinder 1.

All screen cylinders shown in FIGS. 3 to 5, 7 and 8 are provided with an accept channel 8, i.e. the flow centre line of the accept channel 8 and the walls of the accept channel 8 are formed to be continuously curved or as curvedly changing surfaces at least in the first part of the accept channel 8 after the screen slot 3 in the flow direction of the fibre pulp suspension from the feed side 10 of the screen cylinder 1 to the accept side 9. When the walls of the accept channel 8 at least in the first part of the accept channel 8 are formed to be curved, the flow will not collide with the surfaces, instead the flow is directed in a curved manner along the surfaces and the wear caused by the flow subjected thereto is insignificant. Very acute-angled changes of direction on the flow channel could cause the flow to collide with the surfaces of the accept channel, which could result in impeding wear of the collision areas, and as a consequence the screening result deteriorates. When the surfaces of the accept channel are continuous and without any sharp angles, the flow resistance becomes low and the flow becomes even and free of interference, and the throughput of the accept channels becomes high.

At least in the first part of the accept channel 8, the curved accept channel also provides such an advantage that the accept channel is made short, even though the starting direction thereof is turned from the direction of radius R of the screen cylinder 1 in almost a transverse direction. A straight accept channel 8 turned to be transverse from the direction of the radius could be very long. When the accept channel 8 is owing to at least the curved shape of the first part made very short, the measurement variation of the flow cross-sectional area of the accept channel will remain small and the range of the spacing in the screen slots 3 remains small, in which case the flow resistance is formed to be even and remains small. This results in a high capacity and an efficient screening, whereby the screening produces pulp of a more even quality. When the length of the accept channel 8 remains short, the fabrication of a screening surface provided with a low-range slot spacing is easier and also less expensive.

The screen wire 15 of the screen cylinder 1 thus comprises at least one feed side surface 4 to be directed substantially in the direction of the feed side 10 of the screen cylinder 1, at least one first surface 5 to be directed substantially in the opposite direction in relation to feed flow direction A of the fibre pulp suspension, or the first surface 5 of the accept channel 8 of the screen cylinder 1, and at least a second surface to be directed substantially in the same direction in relation to feed flow direction A of the fibre pulp suspension, or the second surface 6 of the accept channel 8 of the screen cylinder 1. The angle between the feed side surface 4 and the surface forming the first surface 5 of the accept channel 8, i.e. in accordance with what is shown in FIG. 3 to 6, the angle between the direction angle $\alpha$ and the elevation angle $\gamma$ is at least 90 degrees, preferably 115 to 180 degrees and most preferably 135 to 160 degrees. The length of the screen wire may vary depending on the screen cylinder. The screen wire 15 may be placed along the entire height of the screen cylinder or along a part thereof. In the examples shown in FIGS. 3 to 6 the screen wire 15 is provided on the circumference of the screen cylinder in the direction of the axis of the screen cylinder, but it may be at an angle in relation thereto, or partly along the height in the direction of the axis and partly along the height at an angle. The screen wire may also be shaped as a curve on the circumference of the screen surface 1 partly at the height of the screen cylinder or completely at the height of the screen cylinder. The total width of the screen wire 15 is typically 1 to 10 mm, but it may also be narrower or wider. Often the width of the screen wire 15 is 2 to 5 mm. The dimension or width of feed side surface 4 of the screen wire in the circumferential direction of the screen cylinder determines how many screen slots 3 are provided on the circumference of the screen cylinder, which in turn affects the discharge through the screen cylinder. The discharge through the screen cylinder 1 generally increases when the dimension in question is narrowed. The dimension is selected to suit the target of application. The selection of dimensions, or widths, of the surfaces 5 and 6 of the accept channel in the circumferential direction and particularly the dimension thereof in the radial direction affect the discharge through the screen cylinder less than the previous one provided that the angles determining by the directions of the surfaces are correctly selected.

In some cases the features shown in this application may be used as such regardless of other features. Then again the features shown in this application can if necessary be combined in order to create different combinations.

The drawings and the specification associated therewith are merely intended to illustrate the idea of the invention. The details of the invention may vary within the scope of the claims. The embodiments in FIGS. 3 to 6 show only wire cylinders, but as mentioned above the solution shown may also be employed in other types of screen cylinders, also in such cylinders, in which screen slots and accept channels are formed in a closed cylindrical billet for instance using mechanical machining or spark machining. What holds true for the structures of screen slots in screen cylinders and accept channels formed in this way is what has above been described.

The invention claimed is:

1. A screen cylinder for cleaning or screening fiber pulp suspension, the screen cylinder comprising screen slots and accept channels for directing the portion penetrated the screen slots to an accept side of the screen cylinder of the fiber pulp suspension fed into a feed side of the screen cylinder, and at least one feed side surface is provided between the screen slots and the accept channels comprise at least one first surface of the accept channel and at least one second surface of the accept channel, wherein the accept channel is arranged in its entirety in a direction opposite to a feed flow direction of the fiber pulp suspension to be fed in the screen cylinder in the direction of the circumference of the screen cylinder in relation to a normal of a tangent of the screen cylinder, which is arranged to pass through the edge of the screen slot that is placed on the side of the first surface of the accept channel and that the first surface and the second surface of the accept channel are curved at least in the first part of the accept channel after the screen slot such that the first surface and the second surface of the accept channel are arranged to curve in the direction of the radius of the screen cylinder such that the accept channel is curved at least in the first part of the accept channel after the screen slot.

2. A screen cylinder as claimed in claim 1, wherein the screen cylinder comprises several screen wires forming a screen surface in the screen cylinder, screen slots being provided between the screen wires, and the screen wires comprise at least one feed side surface, at least one first surface of the accept channel and at least one second surface of the accept channel such that the feed side surfaces of the screen wires are arranged to form the screen surface of the screen cylinder and in that the second surface of the accept channel of the preceding screen wire in the feed flow direction of the fiber pulp suspension and the first surface of the accept channel of the following screen wire in the feed flow direction of the fiber pulp suspension are arranged to form an accept channel between them, through which the portion penetrating the screen slot of the fiber pulp suspension fed into the feed side of the screen cylinder is arranged to transfer from the feed side of the screen cylinder to the accept side.

3. A screen cylinder as claimed in claim 1, wherein a direction angle of the first surface of the accept channel between the tangent of the screen cylinder and the first surface of the accept channel is at least in the first part of the accept channel after the screen slot at least 90 degrees.

4. A screen cylinder as claimed in claim 3, wherein the direction angle is at least in the first part of the accept channel after the screen slot 90 to 170 degrees, preferably 110 to 160 degrees and most preferably 130 to 150 degrees.

5. A screen cylinder as claimed in claim 1, wherein an elevation angle of the feed side surface between the tangent of the screen cylinder and the feed side surface ranges from 0 to 45 degrees, preferably from 5 to 20 degrees.

6. A screen cylinder as claimed in claim 1, wherein the opening angle of the accept channel ranges from 5 to 45 degrees, preferably from 10 to 30 degrees.

7. A screen cylinder as claimed in claim 6, wherein the opening angle of the accept channel is constant.

8. A screen cylinder as claimed in claim 6, wherein the opening angle of the accept channel is arranged to change when moving towards the accept side of the screen cylinder.

9. A screen cylinder as claimed in claim 8, wherein the opening angle of the accept channel is arranged to increase when moving towards the accept side of the screen cylinder.

10. A screen cylinder as claimed in claim 8, wherein the opening angle of the accept channel is arranged at first to increase and then to decrease when moving towards the accept side of the screen cylinder.

11. A screen cylinder as claimed in claim 8, wherein at least one first surface of the accept channel or at least one second surface of the accept channel is a continuously curved surface.

12. A screen cylinder as claimed in claim 8, wherein the accept channel is arranged to open to the accept side of the screen cylinder substantially in the direction of radius of the screen cylinder.

* * * * *